US005461785A

United States Patent [19]

Sol Na

[11] Patent Number: 5,461,785

[45] Date of Patent: Oct. 31, 1995

[54] KNIFE HANDLE WITH SHARPENING GUIDE INDENTATIONS

[76] Inventor: Han Sol Na, 35 Latham Village La., #31, Latham, N.Y. 12110

[21] Appl. No.: 191,559

[22] Filed: Feb. 4, 1994

[51] Int. Cl.[6] ..... B25G 1/00; B26B 3/00

[52] U.S. Cl. ..... 30/138; 30/340

[58] Field of Search ..... 30/138, 139, 165, 30/286, 340; 451/438, 439; 76/82, 88

[56] References Cited

U.S. PATENT DOCUMENTS

| | | | |
|---|---|---|---|
| 794,253 | 7/1905 | Robeson . | |
| 2,124,615 | 7/1938 | Foltz | 30/340 |
| 2,437,495 | 3/1948 | Anderson . | |
| 2,520,355 | 8/1950 | Bell | 30/340 |
| 3,800,632 | 4/1974 | Juranitch | 76/82 |
| 4,512,112 | 4/1985 | LeVine . | |
| 4,731,953 | 3/1988 | Owen . | |
| 4,825,552 | 5/1989 | Bendickson et al. | 30/342 |
| 5,138,801 | 8/1992 | Anthon et al. . | |
| 5,199,225 | 4/1993 | Esposito . | |

*Primary Examiner*—Eugenia Jones
*Attorney, Agent, or Firm*—John R. Flanagan

[57] ABSTRACT

A knife has a handle adapted for gripping by a user's hand and an elongated blade mounted to the handle and extending generally longitudinally outwardly therefrom. The blade defines a longitudinal sharpenable cutting edge for cutting through a variety of materials. The handle has a plurality of pairs of bilateral sharpening guide indentations formed on opposite side portions of a forward end of the handle adjacent to opposite sides of the cutting edge of the knife blade. The pairs of guide indentations are formed at respective different angular relationships to the cutting edge of the blade for facilitating the alignment of an elongated sharpening bar at appropriate angles to the cutting edge to correctly sharpen the knife blade.

19 Claims, 1 Drawing Sheet

12B
12C
12
28
10
26
12E
12D
24
12A
14
20
22
26
22A
22B
18
2
20B
30
30A
16
4

12C
12A
14
20
12E
22B
20A
22
20B
12D
22A
16
5
12
26
18

22
20
20A
22B
22A
18
20B
16

24
30
10
12
30A
30A
20
16
20
18
22
22

12C
10
B
28
24
12A
12D
20
30
14
12
26
22
20A
22B
22A
18
20B
16
30A
20
18
10
16
30A
30
26
30A
12
20

KNIFE HANDLE WITH SHARPENING GUIDE INDENTATIONS

BACKGROUND OF THE INVENTION

1. Field of the Invention

The present invention generally relates to sharpening aids for facilitating the sharpening of knife blades and, more particularly, is concerned with a knife handle with sharpening guide indentations.

2. Description of the Prior Art

Optimal use of the variety of conventional knives generally found in the average household requires their frequent sharpening so as to maintain their effective cutting ability. It is often quite difficult for the average person to accomplish this task satisfactorily in an efficient manner.

A variety of sharpening aids have been devised to provide the average person with greater capability in the knife sharpening process. Representative examples of such aids are disclosed in U.S. patents to Anderson (U.S. Pat. No. 2,437,495), Juranitch (U.S. Pat. No. 3,800,632), LeVine (U.S. Pat. No. 4,512,112), Owen (U.S. Pat. No. 4,731,953), Anothon et al (U.S. Pat. No. 5,138,801) and Esposito (U.S. Pat. No. 5,199,225).

The devices discloses by Anderson, Juranitch, LeVine, Owen and Anothon et al each provides a blade-holding structure designed to present the knife blade at a proper angle for sharpening by a sharpening stone or hone. The LeVine, Owen and Anthon et al devices further include a sharpener element attachable thereto for carrying out the sharpening procedure. Esposito discloses a sharpening guide being essentially a wedge-shaped strip adhesively coated on one side for adhering to a knife blade. Such wedge-shaped strip is provided in both straight and curved forms so as to be fittable separately on the straight and curved portions of a knife blade.

The Anderson device is fairly simple in design and construction, so thereby would probably be inexpensive to manufacture. However, this device would seem to be generally most useful with broad or wide types of blades. The device must enclose a sufficient amount of the blade area therein for the adequate gripping thereof by hand pressure on the device as the knife blade is being sharpened. Consequently, utilization of the Anderson device with narrower blades would seem to be highly problematical.

The Juranitch, LeVine, Owen and Anthon et al devices are each fairly elaborate in design and construction, making manufacture thereof rather expensive. Such design complexity further presupposes a level of mechanical dexterity on the part of the average user which may not in fact be present. A user's lack of such dexterity would generally make utilization of such devices rather awkward and cumbersome and thereby fairly ineffective as sharpening aids.

The Esposito sharpening guide is simple in design and construction for inexpensive manufacture and ease in use. However, it would seem that a fairly strong type of adhesive substance would be required for adhering the guide effectively to a knife blade. The residue of such adhesive left on the blade after removal of the sharpening guide therefrom would necessitate vigorous cleaning of the blade. Such extra effort would be time-consuming and burdensome for the average busy user, making utilization of the Esposito guide rather infrequent.

Consequently, a need still exists for a knife sharpening aid which will overcome the drawbacks of the prior art as described above.

SUMMARY OF THE INVENTION

The present invention provides a knife handle with blade sharpening guide indentations (hereinafter for the sake of brevity being referred to as the improved knife handle) designed to satisfy the aforementioned needs by avoiding the drawbacks of the prior art without introducing other drawbacks. Instead, the improved knife handle of the present invention provides expanded capabilities not available in the prior art devices.

One capability is the simplicity in design and construction of the improved knife handle for allowing inexpensive manufacture thereof. A second capability is the built-in nature of the guide indentations. The indentations are formed directly on the knife handle adjacent to the start of the knife blade. As such, the indentations are both efficient and effective in minimizing amount of space utilized while making it easy for the user to have accessible to them. A third capability is the simplicity in use of the guide indentations in that no special level of mechanical knowledge or skill is required on the part of the user. The guide indentations thus constitute a sharpening aid with respect to which the average user would likely make frequent and efficient use.

Accordingly, the present invention is directed to a sharpening guide structure in combination with a knife having a handle and an elongated blade. The handle of the knife is adapted for gripping by a user's hand and the elongated blade is mounted to the handle and extends generally longitudinally outwardly therefrom. The blade defines a longitudinal sharpenable cutting edge for cutting through a variety of materials. The handle has a plurality of pairs of bilateral sharpening guide indentations formed on opposite side portions of a forward end of the handle adjacent to the cutting edge of the knife blade. The pairs of guide indentations are formed in the forward end of the handle at different respective angular relationships to the cutting edge of the blade for facilitating the alignment of an elongated sharpening bar at appropriate angles relative to the cutting edge to correctly sharpen the knife blade.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figures 1, 2, 3, 4, 5, 6:
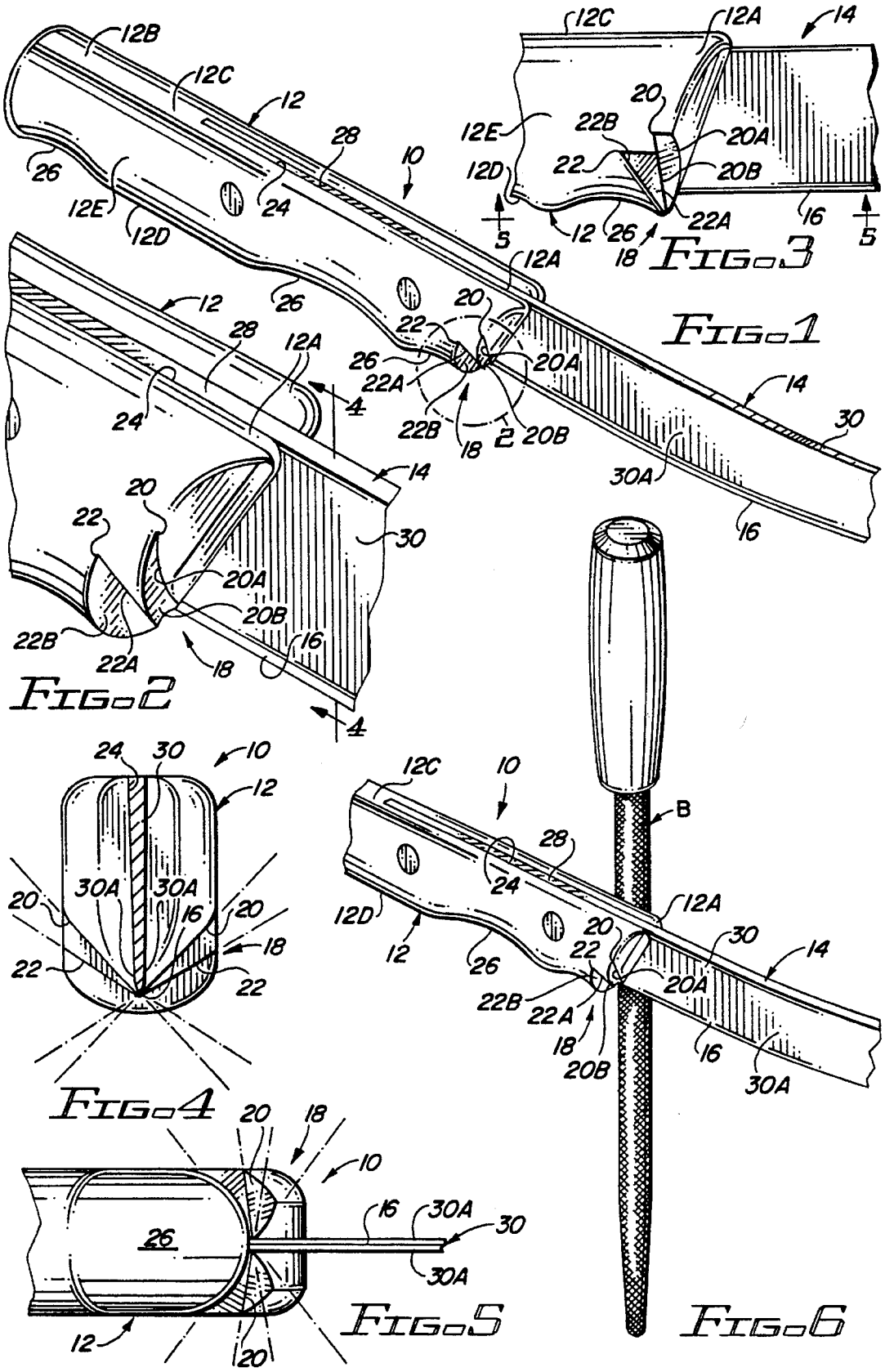
FIG. 1 is a perspective view, partly cut away, of a knife having a handle with sharpening guide indentations in accordance with the present invention.
FIG. 2 is an enlarged perspective view of the portion of the knife handle and blade enclosed within the circle 2 of FIG. 1, showing two individual guide indentations formed on one side portion of the forward end of the knife handle adjacent to the cutting edge of the knife blade.
FIG. 3 is an enlarged side elevational view of the portion of the knife handle and blade enclosed within the circle 2 of FIG. 1, also showing the two individual guide indentations formed on the one side portion of the forward end of the knife handle.
FIG. 4 is a cross-sectional view of the knife taken along line 4—4 of FIG. 2, showing the blade mounted through the handle of the knife and two pairs of bilateral sharpening guide indentations formed symmetrically relative to the cutting edge of the knife blade on opposite side portions of the forward end of the knife handle.
FIG. 5 is a fragmentary bottom plan view of the knife taken along line 5—5 of FIG. 3, showing the two pairs of bilateral sharpening guide indentations formed symmetrically relative to the cutting edge of the knife blade on opposite side portions of the forward end of the knife handle.
FIG. 6 is a perspective view, partly cut away, of the knife having the handle of the present invention and shown with a conventional sharpening bar positioned in alignment with one of the guide indentations for initiating the sharpening of the cutting edge of the knife blade.

Referring to the drawings, and particularly to FIGS. 1–5, there is illustrated a knife, generally designated 10, having a handle 12 and an elongated blade 14 with a longitudinal cutting edge 16 thereon being attached to and thus mounted by the handle 12 in a manner which is conventional and well-known to one of ordinary skill in the art. In accordance with the present invention, the knife handle 12 has a sharpening guide structure 18 in the form of first and second pairs of sharpening guide indentations 20, 22 formed on opposite side portions of a forward end 12A of the handle 12. While two pairs of guide indentations 20, 22 are illustrated on the handle 12, this is for exemplary purposes only. The provision of only a single guide indentation on only one of the pair of opposite side portions of the forward end 12A of the handle 12 is within the purview of the present invention.

Referring to FIGS. 1 and 6, the handle 12 of the knife 10 is a generally straight structure having a pair of opposite forward and rear ends 12A, 12B and pairs of opposite upper and lower surfaces 12C, 12D and of opposite lateral side surfaces 12E, 12F. Also, the handle 12 also has a longitudinal narrow slot 24 defined therethrough along a vertical plane extending through the opposite upper and lower surfaces 12C, 12D and generally parallel to the opposite lateral side surfaces 12E, 12F of the handle 12. The slot 24 opens at and extends rearwardly from the forward end 12A of the handle 12 and terminates at a point located between and spaced between the forward and rear ends 12A, 12B of the handle 12. Also, as seen in FIG. 4, the slot 24 opens at the upper surface 12C of the handle 12 and extends vertically downwardly toward, but terminates before reaching, the lower surface 12D of the handle 12. The lower surface 12D of the handle 12 has a plurality of recesses 26 formed at spaced locations therealong for facilitating gripping of the handle 12 by a user's hand.

Referring to FIGS. 1–6, the blade 14 of the knife 10 has an elongated thin structure preferably composed of a suitable metal, such as stainless steel. The blade 14 has a rear mounting -portion 28 inserted within the longitudinal narrow slot 24 in the handle 12 and a forward cutting portion 30 extending forwardly from the rear mounting portion 28 and forwardly from the narrow slot 24 of the handle 12. The forward cutting portion 30 of the blade 14 is defined by a pair of opposite lateral side surfaces 30A forming the longitudinal sharpenable cutting edge 16.

Referring to FIGS. 1–6, as mentioned above the sharpening guide structure 18 of the present invention being provided on the handle 12 takes the form of the first and second pairs of sharpening guide indentations 20, 22. Each pair of the sharpening guide indentations 20, 22 are defined in the opposite side portions of the forward end 12A of the handle 12 adjacent to the opposite lateral side surfaces 30A of the forward cutting portion 30 of the blade 14. The guide indentations 20, 22 of each pair thereof extend bilaterally from the cutting edge 16 of the blade 14. Also, the guide indentations 20 of the first pair thereof extend at a different angular relationship to the cutting edge 16 than do the guide indentations 22 of the second pair thereof.

More particularly, the pairs of bilateral sharpening guide indentations 20, 22 are defined in the opposite longitudinal lateral side surfaces 12E, 12F and in the lower longitudinal surface 12D of the handle 12. Each guide indentation 20, 22 is a groove 20, 22 formed by a pair of flat surface portions 20A, 20B and 22A, 22B being arranged in a V-shaped configuration. Also, each guide indentation 20, 22 has a substantially straight configuration with the guide indentations 20, 22 of a given pair thereof extending at the same angle to the cutting edge 16 of the blade.

Referring to FIG. 6, it can be seen that the different guide indentations 20, 22 facilitate the alignment of an elongated sharpening bar B therein in an appropriate angle relative to the cutting edge 16 defined by the opposed lateral side surfaces 30A of the forward cutting portion 30 of the blade 14 for correctly initiating and carrying out the sharpening of the cutting edge 16 of the blade 14.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. In combination with a knife having a handle adapted for gripping by a user's hand, an elongated blade mounted to said handle so as to extend generally longitudinally outwardly therefrom and a longitudinal sharpenable cutting edge defined on said elongated blade, a sharpening guide structure comprising:

(a) guide means formed on one end of said handle of said knife adjacent to said cutting edge defined on said blade of said knife;

(b) said guide means being formed in a predetermined angular relationship to said cutting edge of said blade for facilitating alignment of an elongated sharpening bar at an appropriate angle to said cutting edge of said blade to correctly sharpen said blade;

(c) said guide means including at least one elongated guide indentation defined on said one end of said handle of said knife adjacent to one of a pair of opposite sides of said blade of said knife.

2. The knife of claim 1 wherein said guide indentation has a substantially straight configuration.

3. The knife of claim 1 wherein said guide indentation is a groove formed by a pair of flat surface portions arranged in a V-shaped configuration.

4. The knife of claim 3 wherein said groove has a substantially straight configuration.

5. In combination with a knife having a handle adapted for gripping by a user's hand, an elongated blade mounted to said handle so as to extend generally longitudinally outwardly therefrom and a longitudinal sharpenable cutting edge defined on said elongated blade, a sharpening guide structure comprising:

(a) guide means formed on one end of said handle of said knife adjacent to said cutting edge defined on said blade of said knife;

(b) said guide means being formed in a predetermined angular relationship to said cutting edge of said blade for facilitating alignment of an elongated sharpening bar at an appropriate angle to said cutting edge of said blade to correctly sharpen said blade;

(c) said guide means including at least a pair of elongated guide indentations defined on respective opposite side portions of said one end of said handle of said knife, each of said guide indentations being located adjacent to one of a pair of opposite sides of said blade of said knife.

6. The knife of claim 5 wherein each of said guide indentations has a substantially straight configuration.

7. The knife of claim 6 wherein each of said guide indentations extends at the same angle to said cutting edge of said blade.

8. The knife of claim 5 wherein each of said guide indentations is a groove formed by a pair of flat surface portions arranged in a V-shaped configuration.

9. The knife of claim 8 wherein said groove of each of said guide indentations has a substantially straight configuration.

10. The knife of claim 9 wherein each of said guide indentations extends at the same angle to said cutting edge of said blade.

11. The knife of claim 5 wherein each of said guide indentations extends at the same angle to said cutting edge of said blade.

12. In combination with a knife having a handle adapted for gripping by a user's hand, an elongated blade mounted to said handle so as to extend generally longitudinally outwardly therefrom and a longitudinal sharpenable cutting edge defined on said elongated blade, a sharpening guide structure comprising:

(a) a plurality of pairs of bilateral sharpening guide indentations, said guide indentations of each of said pairs thereof being defined on opposite side portions of one end of said handle of said knife adjacent to opposite sides of said blade of said knife;

(b) said pairs of bilateral sharpening guide indentations being formed at respective predetermined different angular relationships to said cutting edge of said blade for facilitating the alignment of an elongated sharpening bar at appropriate angles to said cutting edge to correctly sharpen said blade.

13. The knife of claim 12 wherein:

said handle of said knife has a pair of opposite upper and lower longitudinal surfaces and a pair of opposite longitudinal lateral side surfaces extending between said upper and lower surfaces; and said pairs of bilateral sharpening guide indentations are defined in said opposite longitudinal lateral side surfaces and in said lower longitudinal surface of said handle.

14. The knife of claim 13 wherein each of said guide indentations is a groove formed by a pair of flat surface portions arranged in a V-shaped configuration.

15. The knife of claim 12 wherein each of said guide indentations has a substantially straight configuration.

16. The knife of claim 12 wherein said guide indentations of a given pair thereof extend at the same angle to said cutting edge of said blade.

17. The knife of claim 12 wherein each of said guide indentations is a groove formed by a pair of flat surface portions arranged in a V-shaped configuration.

18. The knife of claim 17 wherein said groove of each of said guide indentations has a substantially straight configuration.

19. The knife of claim 18 wherein said guide indentations of a given pair thereof extend at the same angle to said cutting edge of said blade.

* * * * *